United States Patent [19]

Gainey

[11] 4,141,308

[45] Feb. 27, 1979

[54] AQUATIC DEBRIS REMOVING SYSTEM

[76] Inventor: Russell H. Gainey, 85 Happy Jack La., Port Sulphur, La. 70083

[21] Appl. No.: 614,689

[22] Filed: Sep. 18, 1975

[51] Int. Cl.[2] ..... B63B 35/32

[52] U.S. Cl. ..... 114/270; 115/1 C; 210/242 S

[58] Field of Search ..... 114/67 R, 67 A; 115/1 C; 61/1 F; 210/242 R, 242 S, DIG. 25

[56] References Cited

U.S. PATENT DOCUMENTS

| | | | |
|---|---|---|---|
| 1,889,927 | 12/1932 | MacCallum | 115/1 C |
| 2,651,874 | 9/1953 | Key | 115/1 C |
| 2,914,013 | 11/1959 | Bizjak | 115/1 C |
| 3,326,379 | 6/1967 | Caddick | 210/242 R |
| 3,500,784 | 3/1970 | Reynolds | 115/1 C |
| 3,561,601 | 2/1971 | McNeely | 114/5 RC |
| 3,646,901 | 3/1972 | Budris et al. | 114/5 RC |
| 3,659,713 | 5/1972 | Mueller | 210/242 S |
| 3,698,163 | 10/1972 | Kelpin | 115/1 C |
| 3,752,317 | 8/1973 | Lithen | 210/242 S |
| 3,756,414 | 9/1973 | Crisafulli | 210/242 S |
| 3,762,169 | 10/1973 | Graham | 210/242 S |
| 3,788,264 | 1/1974 | Gibson | 115/1 C |

*Primary Examiner*—Charles E. Frankfort

[57] ABSTRACT

An improved mobile scooping and loading machine used to remove floating debris from waterways regardless of the depth of the water consisting of a boom-operated scoop and its interaction with an air jet propelling mechanism used first to collect the debris to be removed, second to accumulate any floating hydrocabon slicks onto the surface of the debris to be removed and, third to counterbalance the weight of the load to be transported to the disposal sight by use of a horizontal runner placed behind the air jet propelling mechanism.

3 Claims, 4 Drawing Figures

AQUATIC DEBRIS REMOVING SYSTEM

BACKGROUND OF THE INVENTION

The existence of floating debris in waterways is a natural occurance and is as common as waterways themselves. Floating debris has always been a nuisance to man, and he has continually investigated more effective means for removal of said floating debris. Most of the methods for removal of debris are effective when dealing with the removal of large accumulations of debris. However, the major problem in removal of floating debris has been how to effectively remove relatively small amounts of debris randomly floating on the surface of waterways and not yet collected.

Therefore, it is an object of the present invention to provide an effective and efficient method of collecting randomly floating debris, and the subsequent removal of said debris from the waterways.

It should be pointed out that randomly floating debris has never been much of a concern of man. Man has, in the past, simply ignored the nuisance of such randomly floating debris and allowed nature to solve this problem in her usual way. However, in the most recent past, with the advent of the bulk transporation of oil by waterways, the oil slick has come into existence, an oil slick being defined as a thin layer of hydrocarbon, sometimes as thin as one molecule, spread across the surface of a body of water.

It has been well established by environmentalists that in order to prevent long lasting detrimental effects to the environment, the oil slick must be removed from the surface of the waterway. Although there are many methods available for the removal of an oil slick, most are seriously hampered by the presence of randomly floating debris. The natural affinity that oil has for the surface of floating debris causes the oil to attach itself to the surface of all the floating debris within the oil slick area. Therefore, the randomly floating debris must be removed in order to effectuate the complete removal of the oil from the waterway, and terminate the detrimental effects caused by the oil in the waterway.

Therefore, it is the object of the present invention to provide an effective and efficient method for removal of debris, the surface of which has been coated with oil from the surface of a waterway.

Another object of the present invention is to provide an apparatus whereby regardless of the depth of the water or the density of the floating debris or its interaction with an oil slick, the oil and the debris can be removed efficiently and safely from the body of water.

The present invention is capable of sweeping the oil slick into the area that is thick in surface debris thereby allowing the oil to accumulate onto the surface of the debris. Then, the present invention is capable of removing the debris from the surface of the water without having to remove large quantities of water at the same time. In the past the beneficial effects of using an air jet produced from a machine such as an air boat have been used to blow or sweep the oil slick onto the debris that has accumulated on the shores of a waterway. However, great problems have arisen in attempts to anchor the air boat such that a stronger jet of air can be forced in the sweeping operation. The use of anchors have caused great time delays in attempts to unseat the anchors once they have become firmly embedded in the waterway bottom. Additionally, spuds have been positioned on opposite sides of the air boat and sunk sufficiently deep into the bed of the river or waterway to prevent movement of the vessel. These, too, are very time-consuming in getting them positioned correctly, as well as removal after the particular sweep has been made. The present invention with its interaction of scooping mechanism which can be tilted so as the prongs of the scoop can be embedded into the floor of the waterway offers great advantages in quickly setting for a sweep and quickly relocating to make another sweep.

In the past once the oil has been blown into a cul-de-sac or other accumulation area in which much debris has accumulated, workmen were required to either paddle out in flat bottom boats or wade out and pick up each individual piece of driftwood and other debris individually, load it into the boat, and then transport the boat to shore and unload the boat. By use of the present invention this is eliminated in that once the sweep has been made and the oil is accumulated on the various debris along the shore or in the cul-de-sac or in other accumulated areas, the scooping mechanism can be lowered below the surface of the water, a forward thrust created by the air boat can be used to force the prongs of the scoop beneath the surface of the debris regardless of how shallow the water is. At this point, the debris can be accumulated in the scoop and piled up against the back of the scoop. Because the scoop is made of prongs, it will not retain water thereby allowing a greater weight of debris to be carried to shore with each run of the boat. Another very advantageous aspect of the present invention is that when the debris is to be lifted from the surface of the water with the air boat still trying to make forward progress into the debris, an air foil, horizontally positioned behind the propeller, can be positioned so as to cause a jet stream to be forced upward, thereby countebalancing the weight of the scoop as it comes out of the water. This interaction allows the boatmen to maintain the deck level for greater safety as well as for a greater weight per load of the scooping mechanism. Once the loaded scoop has been raised above the surface of the water, by interaction of the hydrofoil and the revolutions per minute of the motor, the boat can be maneuvered so as to glide up and over the debris located in front of the boat and onto the shore where the load can be dumped into a container or on to the shore.

Therefore it is an object of the present invention to provide a method of counterbalancing the weight of the debris lifted by the scoop.

Various other objectives, distinctions and advantageous features of the invention will become apparent from the description of the preferred embodiment below.

DESCRIPTION OF THE PREFERRED EMBODIMENT

Figures 1, 2:
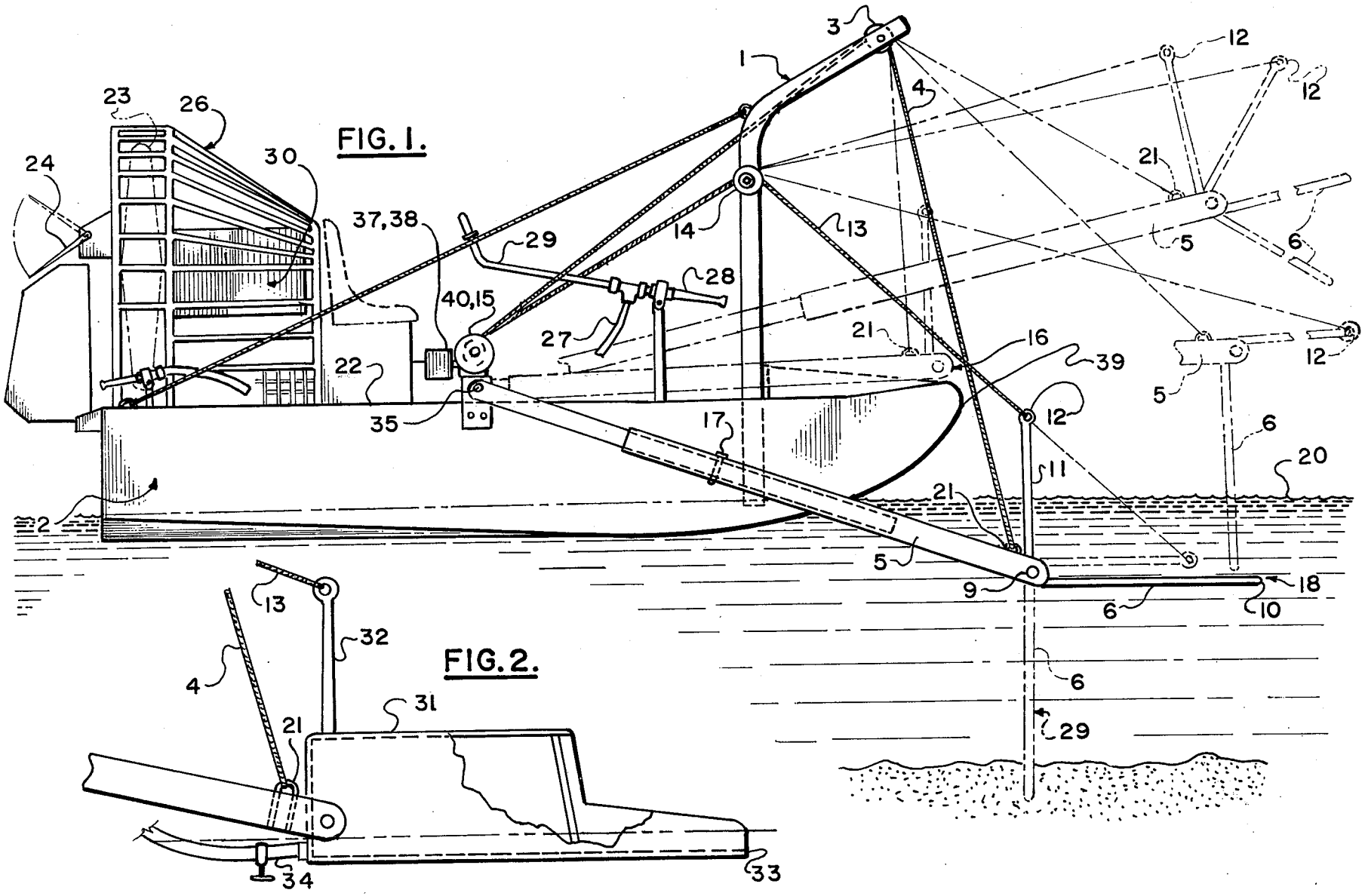
FIG. 1 is a right side view of the complete machine of the present invention showing the boom and scoop in several different positions, extended and non-extended, as well as the air jet propelling mechanism.
FIG. 2 is a right side view of an enclosed oil scoop mechanism attached to the boom.

The present invention, as illustrated in FIG. 1, consists of a mast (1) mounted to a floating structure, in particular a boat (2). The mast (1) supports on its topmost extreme a pulley (3). Pulley (3) supports the cable (4), which in turn supports a U-shaped telescopic boom (5). The cable (4) is engaged to a winch (40), such that by drawing in or letting out a length of cable (4), the elevation of the outer end of the u-shaped boom (5) can be varied. The arms of the u-shaped boom (5) are pivotly connected at points (35) and (36) slightly to the rear of the mid-point of the floating structure (2). Attached to the base of the u-shaped telescopic boom (5) which forms the front most part of the boom (5) with respect to the floating structure (2) is a scoop (6).

Figure 3:
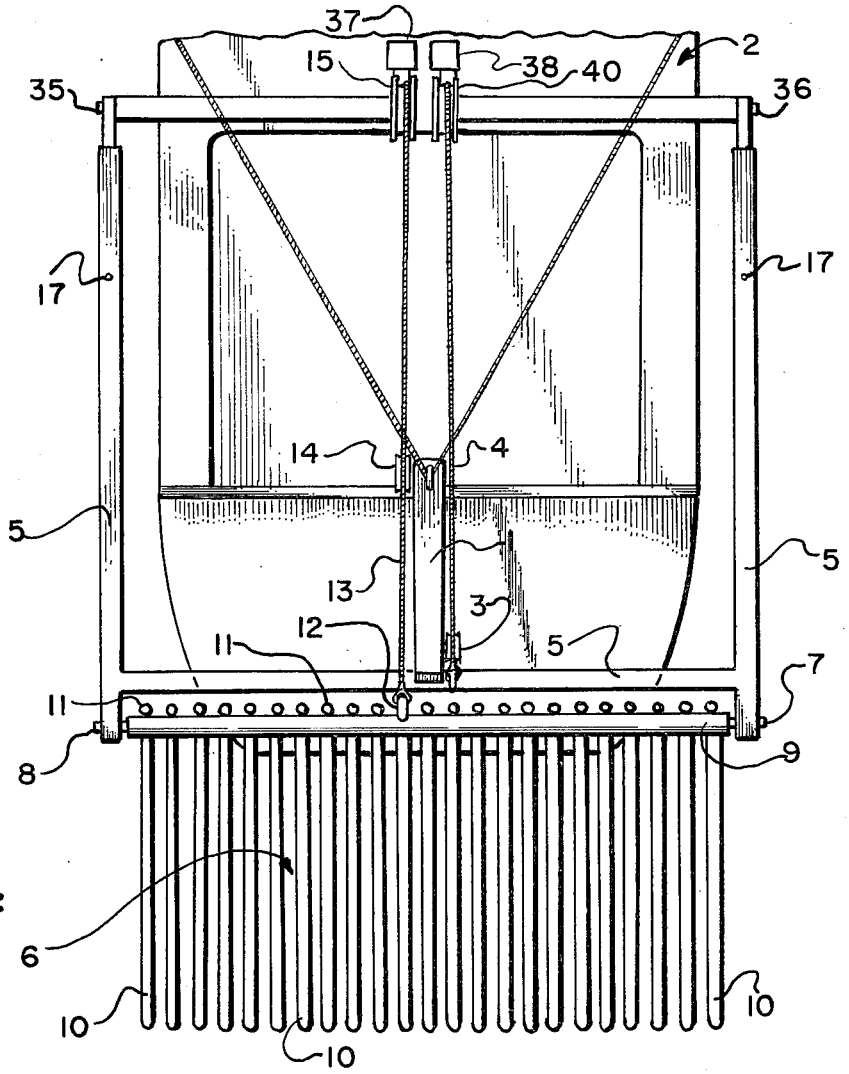
FIG. 3 is a top view of the scoop illustrating the prongs of an alternative embodiment of said scoop.
Figure 4:
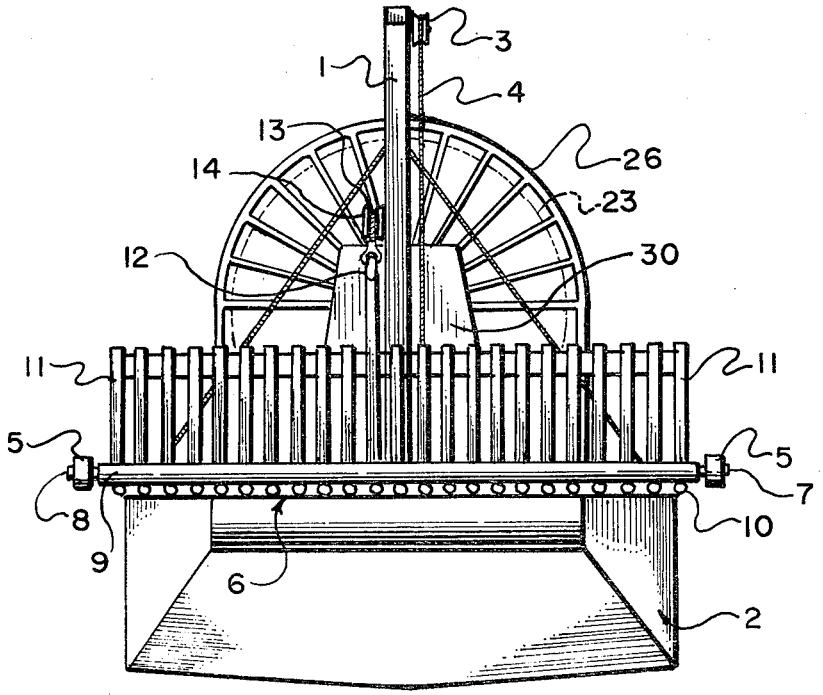
FIG. 4 is a front view of the floating structure and scoop illustrating the scoop in a static position.

Scoop (6) is pivotly attached by an axle (9) to the u-shaped boom (5) at points (7) and (8) respectively, as best seen in FIG. 3.

The axle (9) supports a series of prongs (10) attached perpendicular to the axle (9) which provide the base or floor of the scoop (6). Likewise, another series of prongs (11) are also supported by axle (9), which are perpendicular to the axle (9) and are also perpendicular to the prongs (10). The prongs (11) form the back of the scoop (6).

One of the prongs (11) which is located at the midpoint of the axle (9) is provided at its outermost end with an eyelet (12) to which is attached a cable (13). Cable (13) is supported on the mast (1) by pulley (14). The cable (13) is engaged to a winch (15) such that the activation of the winch (15) will ultimately change the pitch of the prongs on the scoop (6). The winches (40) and (15) are either manually or automatically activated, either hydraulic air or clutch motor driven (37) and (38) respectively. Said winches must be capable of ultimately supporting the load to be carried within the scoop (6). The telescopic arms of the u-shaped boom (5) are adjustable manually and pins (17) respectively hold the telescopic arms of the u-shaped boom in the desired position. However, it should be noted that the arms can be adjusted hydraulically or by other automatic means.

The floating structure (2) in the preferred embodiment is an air boat, however, any movable floating structure would suffice. In the preferred embodiment, the air boat (2) operation gives a particular desired variable, which enhances the effect of removing debris from the waterways as said particular desired variable will be described in detail in the operation of the floating structure (2) and said scoop (6) below.

Operation of the present invention in the removal of debris from waterways is as follows:

The u-shaped boom (5) is extended from the static or rest position (16) where it is normally kept during non-operation. The boom (5) is extended to a point forward of the bow (39) of the floating structure (2). Said point forward of the bow (39) will be determined depending on the height to which it is desired to raise the loaded scoop (6). In any case, the boom must be extended so that the base of the u-shaped number will clear, that is fall below, the front end of the floating structure (2) to position (18) as noted in FIG. 1.

When the boom (5) is in the extended position, the ends of the boom (5) can be lowered by operation of the winch (6) to a position below the surface of the water (20). The ultimate depth to which the boom can be lowered is only limited by the length of the boom (5). On the other hand, the height to which the boom can be raised is limited by the height of the pulley (3) which is mounted on the mast (1). By varying the length of the cable (4) engaged to winch (40), any intermediate position of the boom can be selected.

Simultaneously, the position of the scoop (6) can be maintained by operation of the winch (15) so as to position the prongs (10) parallel to the surface of the water and just below it, or sufficiently below it, so as to be beneath the debris to be removed from the waterway.

The removal of the debris from shallow waters and placing it upon the shore or in a container located on the shore is as follows: Starting with the boom (5) in the rest position (16) activate the winch (40) so as to pull in cable (4) which transfers the majority of the weight of the boom (5) and the scoop (6) to the pulley (3) by locating pulley (3) directly over the eyelet (21). The transfer of the weight from the bow of the boat to pulley (3) will be accomplished without causing an unbalancing or unleveling of the deck (22) of the floating structure (2). Now, with the boom (5) suspended, the pins (17) can be removed, the telescopic arms extended to a position sufficient to allow the desired height for unloading into a container and likewise to a desired position sufficiently forward of the bow of the boat to allow submersion of the u-shaped boom below the surface of the water. With the pins (17) located wihin the telescopic arms so as to hold the telescopic arms in the desired extended position, the winch (40) can be activated to either raise or lower the boom as desired.

It should be noted that cable (13) connected to eyelet (12) and in turn to the scoop (6) must also simultaneously be activated in order to accomplish the extension of the boom (5).

When the preselected extension of arms is accomplished, pins (17) should be replaced so as to prevent the arms from sliding back into the original rest position (16).

Next, the boom (5) can be lowered just below the surface by unwinding cable (4) from winch (40). Simultaneously, the scoop (6) with prongs (10) should be kept parallel to the surface of the water, or slightly slanted forward. The regulation of the prongs (10) of the scoop (6) are accomplished by unwinding the winch (15). Once the boom and scoop (6) are in position below the surface, sufficient to allow the prongs (10) to slide under the debris to be removed from the waterway, the floating structure (2) can be propelled forward.

The propelling of the boat forward is accomplished by a high speed motor (30) engaged to a propeller (23), which produces an air jet stream to the rear of the floating structure (2). The force of air stream produced by the propeller (23) is directly proportional to the revolutions per minute of the engine (30) as is the normal case with the operation of the air boat.

Once the scoop is beneath the debris to be removed from the waterway, the rewinding of cables (4) and (13) respectively will effectuate the lifting of the debris from the waterway and suspension of it upon the prongs of the scoop (6). The design of the scoop (6) allows the water, which may be carried upward with the lifting of the scoop (6) to drain from the debris thereby lightening the load considerably and allowing for more weight to be carried upon the prongs of the scoop (6) rather than wasting energy in lifting of great quantities of water.

It should be noted that during the lift operation, maintaining the deck in a relatively level position is very desirable from a safety aspect as well as workability. In order to accomplish this feat, a rudder-like air foil (24) positioned to the rear of the propeller (23) and horizontally pivoted so at the sides of the propeller screen (26) such that the pitch can be changed so as to direct the airstream up so as to counterbalance the weight of the load being accepted by the scoop (6). As the water drains from the load being accepted by the scoop (6), the speed of the engine will be lessened so as to decrease the force of the air jet stream being deflected by the air foil (24), thereby maintaining the deck of the floating structure (2) relatively parallel to the surface of the water. Simultaneously, the direction of the air foil (24) can be changed so as to counterbalance the loss of weight from the drainage of the water while still maintaining the forward speed. The forward speed of the boat is necessary in transportation of the loaded debris from the pick-up area to the shore. Additionally, it should be pointed out that the counterbalance mechanism of the air foil (24) and the scoop (6) is very important in allowing the bow (39) of the boat (2) to ride up and over the debris located between the boat and the shore. With the winches (15) and (40) activated to raise the loaded scoop to the desired height so as to enable dumping of the load onto the shore or into a container as desired, when the boat is level, the normal construction of the bottom of the boats provides sufficient angles so as to allow the boat to ride up and over the debris and onto the shore so long as the deck of the boat remains level. Upon reaching the shore, the boom (5) and scoop (6) can be raised even to a higher point so as to allow dumping into a rather high container as the back end of a dump truck or other container located upon the shore. Once the front part of the floating structure (2) has engaged the shore, the balancing of the deck (22) of the floating structure (2) becomes less important; however, it should be pointed out that in deep water the raising and lowering of the scoop (6) will have an adverse effect on the rear of the floating structure (2), if, in fact, the air foil (24) were not in position to prevent the rear of the floating structure (2) from taking in water. This, of course, is done by placing the air foil (24) in a position to direct the airstream in a downward direction, thereby lifting the rear of the boat and counterbalancing the heavy load being dumped in the front of the floating structure (2). The dumping operation is to release the winch (15) and thereby allow the cable (13) to extend, and, in turn, permit the axle (9) to pivot between points (7) and (8), thereby effectuating a movement of the prongs (10) from a horizontal position to a vertical position and prongs (11) from a vertical position to a horizontal position. The effect of this rotation causes the debris located within the scoop to fall to the earth, either into a container, or onto the shore, as desired. The next step in the loading, unloading operation is the removal of the floating structure (2) and scoop (6) from the shore to effectuate another load. This is most easily accomplished by a reversal of the propeller (23) drive (30), thereby causing an air jet stream to flow in the opposite direction which in turn will force the floating structure (2) from the shore, back onto the waterway.

One of the many problems that are inherent to the collection of the debris upon water are solved by the present invention through the operation of jets of water and air to sweep or gather the loose debris into locations which make removal of the debris from the water much simpler. In the preferred embodiment of the present invention, a water jet system is supplied by a high pressure water pump located in the boat not shown and transmitted to the deck by a flexible hose (27) and to a nozzle (28). Nozzle (28) is manipulated to the desired direction by handle (29). The water jet hitting the surface of the water will cause the oil, wood, algae, lilies, and other debris to be swept into the desired location, such that the scoop (6) can more effectively remove said debris from the waterway and subsequent transportation of the debris to the shore for loading into a container or onto the shore itself.

As for the use of the airstream for accumulation of the debris to a more suitable loading arrangement, it must be considered that the airstream is normally used to move the floating structure (2) itself; therefore, when one attempts to use the airstream to move the debris rather than the boat, one is faced with the problem of preventing the floating structure (2) from moving. It is here that a unique characteristic of the design of the present scoop (6) comes into play. The scoop (6) itself can be used to prevent the movement of the floating structure (2). The scoop (6) is positioned as seen in phantom lines (29). By lowering the boom (5) below the surface of the water while the scoop (6) is in the dumping position, that is with prongs (10) vertical and prongs (11) horizontal, the tips of prongs (10) will contact and penetrate the bottom of the waterway, thereby preventing forward movement of the boat. With the prongs (10) firmly embedded in the stream in the waterway bottom, the revolutions per minute of the motor (30) can be increased, thereby causing a greater airstream to be produced by the propeller (23) and causing the debris and oil to be moved upon the top of the water while the water jet is primarily used for collection of large debris such as driftwood, water plants not attached to the bottom, and algae.

As an alternate to the prong scoop (6) and to deal particularly with oil slicks, an alternate type scoop (31) with tilt activator (32) which in turn is connected to cable (13) is provided for this service. When the oil slick is accumulated into a cul-de-sac or other appropriate accumulation pit by the direction of the air and water jets, the scoop (6) is removed from the boom (5) by disengaging swivel points (7) and (8). Scoop (31) may then be connected to boom (5) by engaging swivel point (7) and (8) with Scoop (31). The scoop (31) is lowered just below the surface of the water, so that the lip (33) of the scoop (31) is below the thickness of the oil layer. The airboat (2) can be propelled forward to accumulate the oil within the scoop (31). The scoop (31) is equipped with a drain (34) which by use of a pump causes the liquid accumulated within the scoop to be pumped from the scoop (31) into a vessel internal to the floating structure (2) in which decanting of the oil and water takes place. Said decanting allows the water to flow back into the waterway while maintaining the oil within the vessel. A normal oil-water interface is used to protect the level of oil within the vessel, thereby assuring that no oil is allowed to flow back into the waterway.

I claim:

1. An apparatus for removing floating matter from the surface of a body of water, comprising:

a. a buoyant support structure;

b. propeller means associated with and mounted on said buoyant structure for moving said buoyant structure across the surface of said body of water; and c. scoop means connected to said support structure for removing said floating matter from the surface of said body of water, said scoop means provided with a plurality of substantially parallel elongated tines, said tines being capable of anchorably securing said scoop to the water bottom of said body of water.

2. The apparatus of claim 1 wherein said propeller means is mounted on the upper portion of said buoyant structure and above the surface of said body of water, and said propeller means effects motion of said buoyant structure across the surface of said body of water by creating a high speed jet of air with respect to said support structure, and said high speed jet of air created by said propeller means is capable of urging said floating matter across the surface of said body of water.

3. The method of removing randomly floating debris from the surface of a body of water comprising the steps of:

a. providing an apparatus for the removal of floating debris from the surface of a body of water, said apparatus comprising —
   (i) a support structure;
   (ii) propeller means associated with said buoyant structure for moving said buoyant structure across the surface of said body of water;
   (iii) scoop means connected to said support structure for removing said floating debris from the surface of said body of water, said scoop means provided with an anchoring tip portion, said anchoring tip portion capable of anchorably attaching said scoop means to the water bottom of said body of water; and
   (iv) stabilizer means on said support structure for maintaining said support structure in a substantially horizontal position on the surface of said body of water;
b. positioning the anchoring tip portion of said scoop means in a lowered position below the surface of said body of water so as to engage said tip portion of said scoop means in an anchoring position with the bed of the body of water;
c. directing said high speed jet of air upon said randomly floating debris so as to urge said floating debris toward a collection point;
d. disengaging the anchoring tip portion of said scoop means from the bed of said body of water;
e. removing said floating debris from the surface of said body of water with said scoop means;
f. positioning said stabilizer to maintain said support structure in a substantially horizontal orientation;
g. discharging said floating debris from said scoop means at a debris disposal site.

* * * * *